US007235023B2

(12) United States Patent
Sugimoto

(10) Patent No.: US 7,235,023 B2
(45) Date of Patent: Jun. 26, 2007

(54) IRON TYPE GOLF CLUB SET

(75) Inventor: Yasushi Sugimoto, Kobe (JP)

(73) Assignee: SRI Sports Limited, Kobe-shi (JP)

( * ) Notice: Subject to any disclaimer, the term of this patent is extended or adjusted under 35 U.S.C. 154(b) by 173 days.

(21) Appl. No.: 10/726,633

(22) Filed: Dec. 4, 2003

(65) Prior Publication Data

US 2005/0003900 A1 Jan. 6, 2005

(30) Foreign Application Priority Data

Dec. 6, 2002 (JP) ..... 2002-355602

(51) Int. Cl.
*A63B 53/04* (2006.01)

(52) U.S. Cl. ..... 473/291; 473/342; 473/350

(58) Field of Classification Search ..... 473/290–291, 473/342, 350
See application file for complete search history.

(56) References Cited

U.S. PATENT DOCUMENTS 1,927,083 A * 9/1933 Davis ..... 473/242
3,751,035 A * 8/1973 Lockwood ..... 473/290
4,848,747 A * 7/1989 Fujimura et al. ..... 473/291
4,874,171 A * 10/1989 Ezaki et al. ..... 473/290
5,242,167 A * 9/1993 Antonious ..... 473/350
5,295,686 A * 3/1994 Lundberg ..... 473/291
5,524,880 A * 6/1996 Kobayashi ..... 473/291
5,669,824 A * 9/1997 Aizawa et al. ..... 473/291
5,885,166 A * 3/1999 Shiraishi ..... 473/291
6,379,262 B1 * 4/2002 Boone ..... 473/324

FOREIGN PATENT DOCUMENTS

JP 9-192270 * 7/1997
JP 2000-084127 A 3/2000
JP 2001-029523 A 2/2001

* cited by examiner

*Primary Examiner*—Stephen L. Blau
(74) *Attorney, Agent, or Firm*—Birch, Stewart, Kolasch & Birch, LLP

(57) ABSTRACT

The present invention provides an iron type golf club set of n (n: an integer equal to or more than three) numbers of iron type golf clubs having different head loft angles, wherein the head comprises a face plate, and a head main body provided with a face receiving portion supporting a peripheral edge portion of the face plate around an opening portion, the face plate has one thin portion having the smallest thickness and at least one thick portion having a larger thickness than the thin portion, in a free deflection area in which a back surface faces to the opening portion, and in a standard state, a horizontal distance Xi along a hitting face between a face center and a center of figure of the thin portion satisfies the following conditions (1) and (2):

$$X1 \leqq X2 \leqq \ldots \leqq Xn; \text{ and} \quad (1)$$

$$X1 < Xn. \quad (2)$$

15 Claims, 11 Drawing Sheets

IRON TYPE GOLF CLUB SET

This Nonprovisional application claims priority under 35 U.S.C. § 119(a) on Patent Application No(s). 2002-355602 filed in JAPAN on Dec. 6, 2002, the entire contents of which are hereby incorporated by reference.

BACKGROUND OF THE INVENTION

1. Field of the Invention

The present invention relates to an iron type golf club set which can obtain the longest carry in each number of irons while maintaining a durability.

2. Description of the Related Art

For example, Japanese Unexamined Patent Publication No. 2001-29523 discloses, as shown in FIG. 12, an iron type head "a" constituted by a face plate "b" forming a main portion hitting a ball, and a head main body "c" supporting the face plate "b". The face plate "b" is formed by using a metal material, having a small specific gravity, such as titanium or titanium alloy, and the head main body "c" is formed by using a metal material, having a greater specific gravity than the face plate "b", such as stainless steel. The head main body "c" is provided, for example, with an opening portion O, and is provided with a face receiving portion supporting a peripheral edge portion of the face plate "b" around the opening portion O. Accordingly, a free deflecting area "d" which is not supported to the head main body "c" is formed in a center portion of the face plate "b".

The head "a" has a low position of center of gravity and a large depth of center of gravity. Accordingly, the head reduces a probability of miss shot, and a beginner can easily hit a ball with the head. In this case, a plurality of iron type golf clubs are normally brought together and used as a set. The respective clubs in the set are different in a shaft length, a loft angle, a lie angle and the like. In particular, the shaft length is greater and the lie angle is smaller, in accordance with the club in the smaller number having the smaller loft angle. In accordance with the property of the club, a normal armature golfer tends to hit the ball on a toe side of a hitting face in accordance with the club in the smaller number, and inversely tends to hit the ball on a heel side of the hitting face in accordance with the club in the larger number.

As a result of researches of the present inventors, the conventional head includes a head in which a sweet spot is set in conformity with a hitting position of an armature golfer. However, in order to obtain the longest carry in each number of the iron, it is necessary to effectively position a thin portion "d1" having a good repulsion against the ball at the hitting point of the golfer.

SUMMARY OF THE INVENTION

The present invention is made by taking the above problems into consideration, and a main object of the present invention is to provide an iron type golf club set which can obtain the longest carry in each number of irons while maintaining a durability, on the basis of a structure that a center of figure of a thin portion having the smallest thickness and formed in a free deflection area of a face plate is moved close to a ball hitting position of an average golfer in correspondence to the number of the iron.

In accordance with the present invention, there is provided an iron type golf club of n (n: an integer equal to or more than three) numbers of iron type golf clubs having different head loft angles, wherein the head comprises a face plate, and a head main body provided with a face receiving portion supporting a peripheral edge portion of the face plate around an opening portion, the face plate has one thin portion having the smallest thickness and at least one thick portion having a larger thickness than the thin portion, in a free deflection area in which a back surface faces to the opening portion, and in a standard state where the head is mounted on a horizontal plane by a specified lie angle and loft angle, a horizontal distance Xi along a hitting face between a face center and a center of figure of the thin portion (in this case, the horizontal distance Xi is negative in the case where the center of figure exists on a toe side rather than the face center, and is positive in the case where the center of figure exists on a heel side. Further, reference symbol i is a natural number of 1 to n and is given in a sequential order from the club having the smallest loft angle in the set) satisfies the following conditions (1) and (2):

$$X1 \leqq X2 \leqq \ldots \leqq Xn; \text{ and} \quad (1)$$

$$X1 < Xn. \quad (2)$$

DETAILED DESCRIPTION OF THE INVENTION

Description will be given below of an embodiment in accordance with the present invention with reference to the accompanying drawings.

Figure 1A:
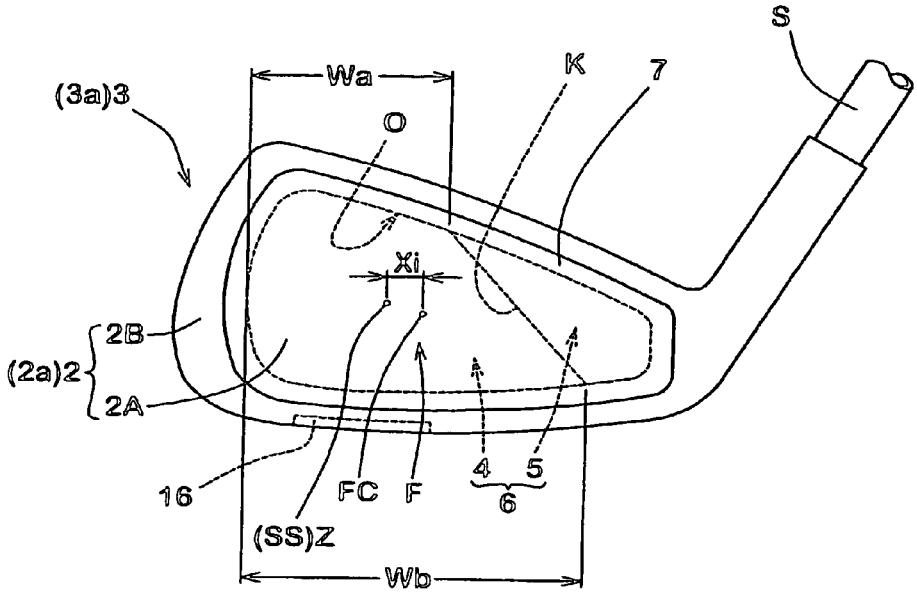
FIG. 1A is a front view showing an embodiment of an iron type golf club in accordance with the present invention.
Figure 1B:
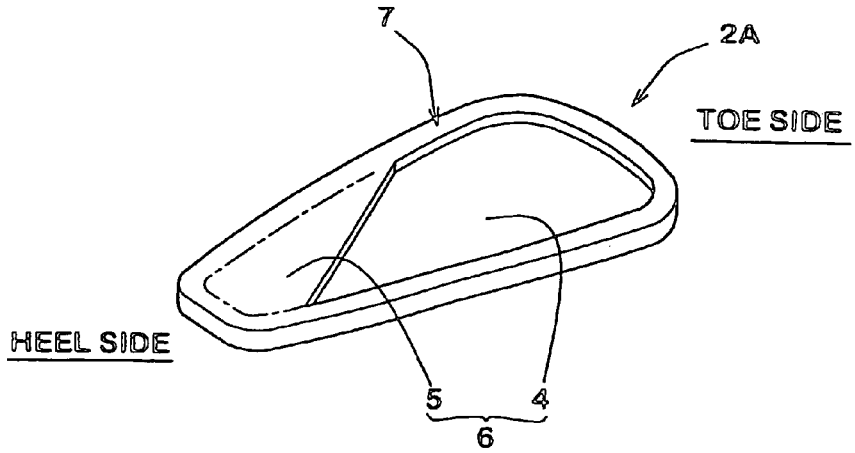
FIG. 1B is a perspective view of the iron type golf club as seen from its back surface from which a face plate is detached.
Figure 2A:
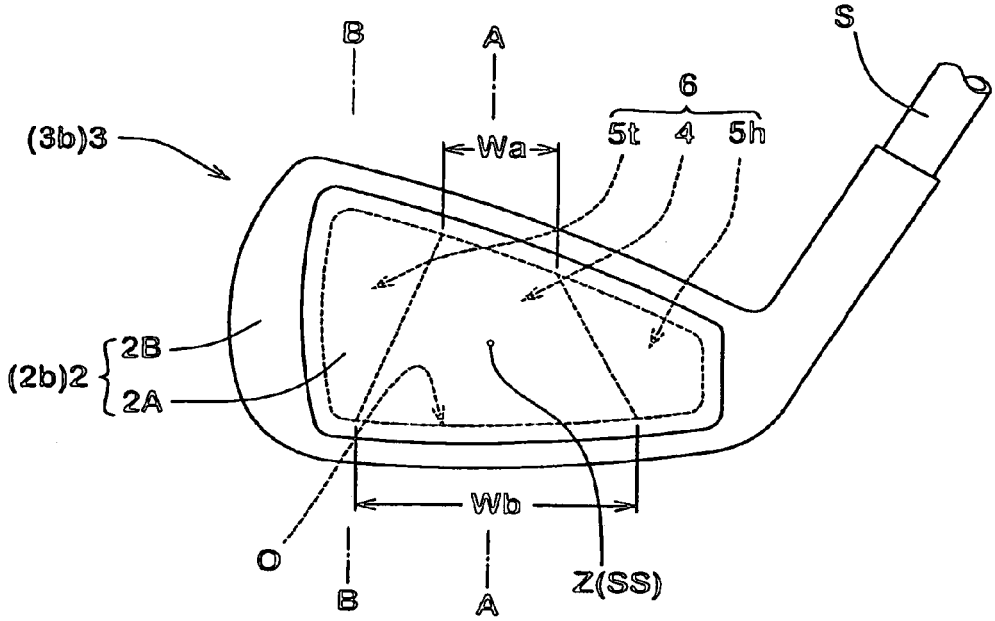
FIG. 2A is a front view showing an embodiment of an iron type golf club in accordance with the present invention.
Figure 2B:
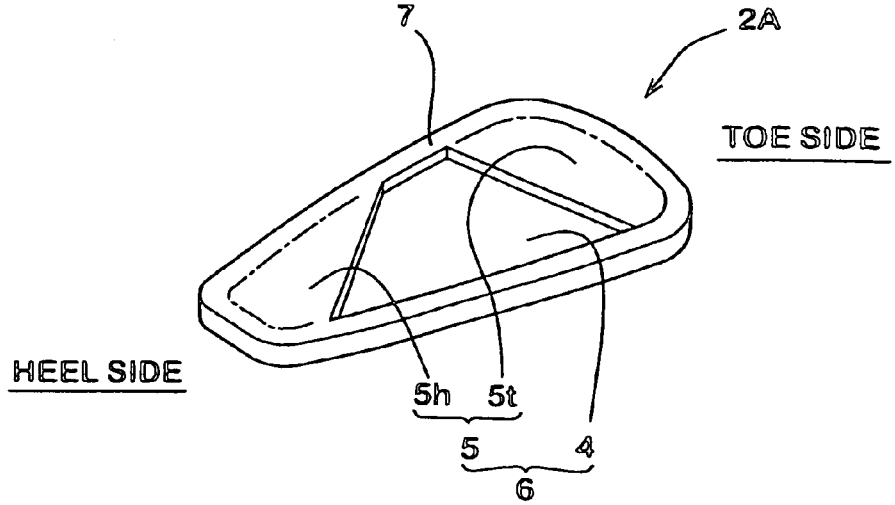
FIG. 2B is a perspective view of the iron type golf club as seen from its back surface from which a face plate is detached.
Figure 3A:
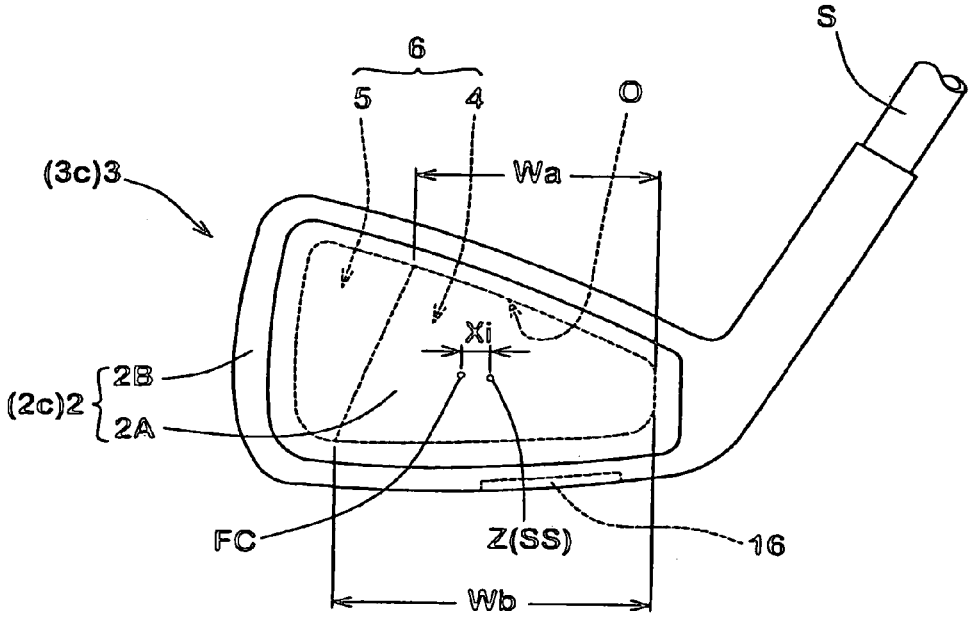
FIG. 3A is a front view showing another embodiment of an iron type golf club in accordance with the present invention.
Figure 3B:
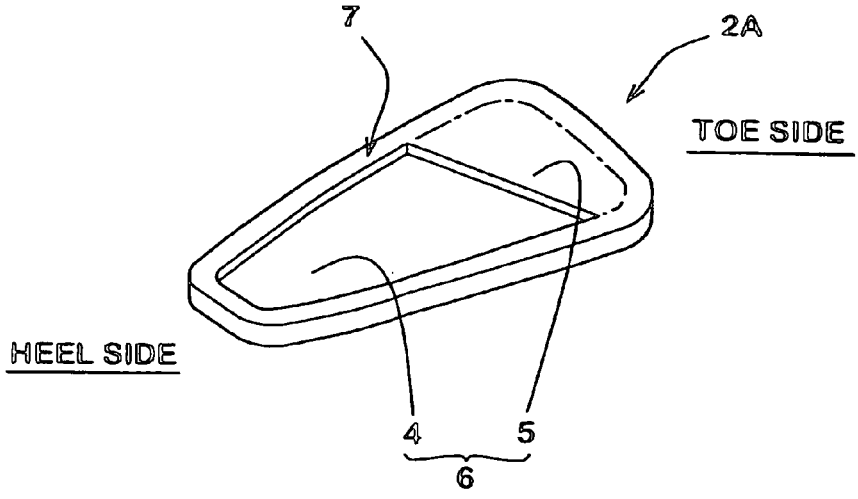
FIG. 3B is a perspective view of the iron type golf club as seen from its back surface from which a face plate is detached.

FIGS. 1A and 1B show a third iron (loft angle: 20°) as an iron type golf club, FIGS. 2A and 2B show a sixth iron (loft angle: 29°) and FIGS. 3A and 3B show a pitching wedge (loft angle: 45°), respectively. Each of FIGS. 1A, 2A and 3A is a front view of a standard state where a head is grounded on a horizontal plane in accordance with specified lie angle and loft angle, and each of FIGS. 1B, 2B and 3B shows a perspective view of the head as seen from its back surface side from which a face plate 2A constituting a head 2 is detached.

An iron golf club set (hereinafter, simply referred to as a "set" in some cases) 1 in accordance with the present embodiment is constituted by n numbers (n: an integer equal to or more than three) of iron type golf clubs (hereinafter, simply referred to as a "club") 3*a*, 3*b* . . . having different loft angles of the heads 2*a*, 2*b*. . . .

For example, in the set 1, the minimum loft angle is set between 10° and 25°, and the maximum loft angle is set between 45° and 60°. It is preferable that the loft angle is changed by 3° to 10° between the adjacent number of iron clubs. Further, the total number of the clubs included in the set 1 is at least three, preferably set equal to or more five, more preferably set equal to or more than seven, and still more preferably set to seven to ten. In accordance with a concrete embodiment, there are a half set constituted by irons in odd numbers or even numbers (for example, in the case of the third iron, the iron means numeric value "3"), a set including seven irons comprising third to ninth irons, and a set obtained by adding one or more of a pitching wedge (PW), an approach wedge (AW) or a sand wedge (SW) to the above set. The set 1 in accordance with the present embodiment is constituted by ten clubs obtained by adding three strong and sturdy irons PW, AW and SW to the third to ninth irons. In accordance with the customs, a shaft S attached to the head 2 is gradually shortened in accordance with an increase in the loft angle.

Figure 4:
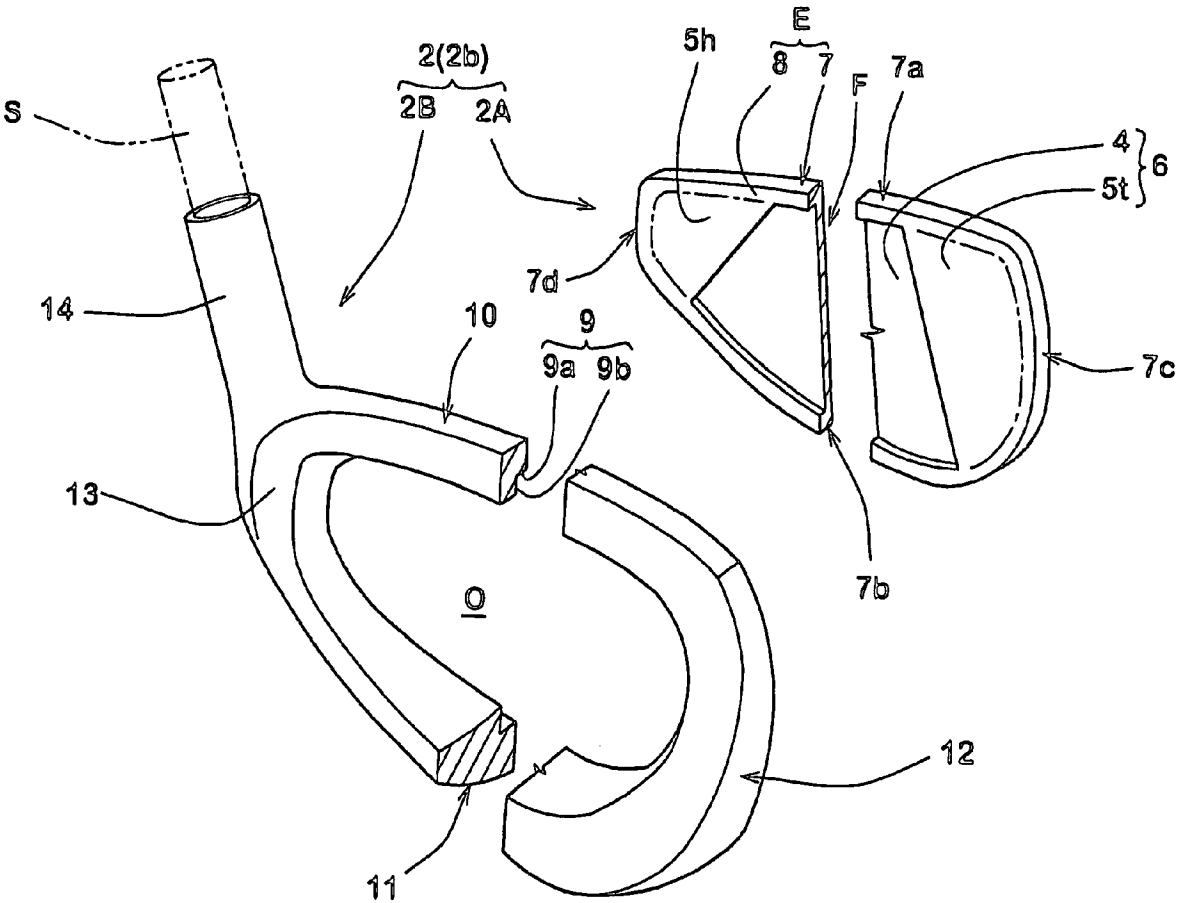
FIG. 4 is an exploded perspective view of a head showing an embodiment in accordance with the present invention.

Each of the heads 2 included in the set 1 in accordance with the present embodiment is constituted by a face plate 2A made of a metal material, and a head main body 2B made of a different metal material from the face plate 2A, as shown in FIG. 4. The head main body 2B has an opening portion O, and is provided with a face receiving portion 9 supporting a peripheral edge portion E of the face plate 2 in a portion around the opening portion O.

The face plate 2A is formed in a plate shape constituting a main portion of a hitting face F in the present embodiment, and is formed in an approximately long sideways rectangular shape having an outer peripheral surface 7 including an end surface 7*a* in a side of a top portion, an end surface 7*b* in a side of a sole portion, an end surface 7*c* in a side of a toe portion and an end surface 7*d* in a side of a heel. In this case, it goes without saying that a profile shape of the face plate 2A can be modified variously in addition to the illustrated shape. Further, in the face plate 2A, the peripheral edge portion E is supported to the head main body 2B. The peripheral edge portion E of the face plate 2A includes the outer peripheral surface 7, and a back surface edge portion 8 (shown by a virtual line in FIG. 4) forming a small width from the outer peripheral surface 7.

Figure 6:
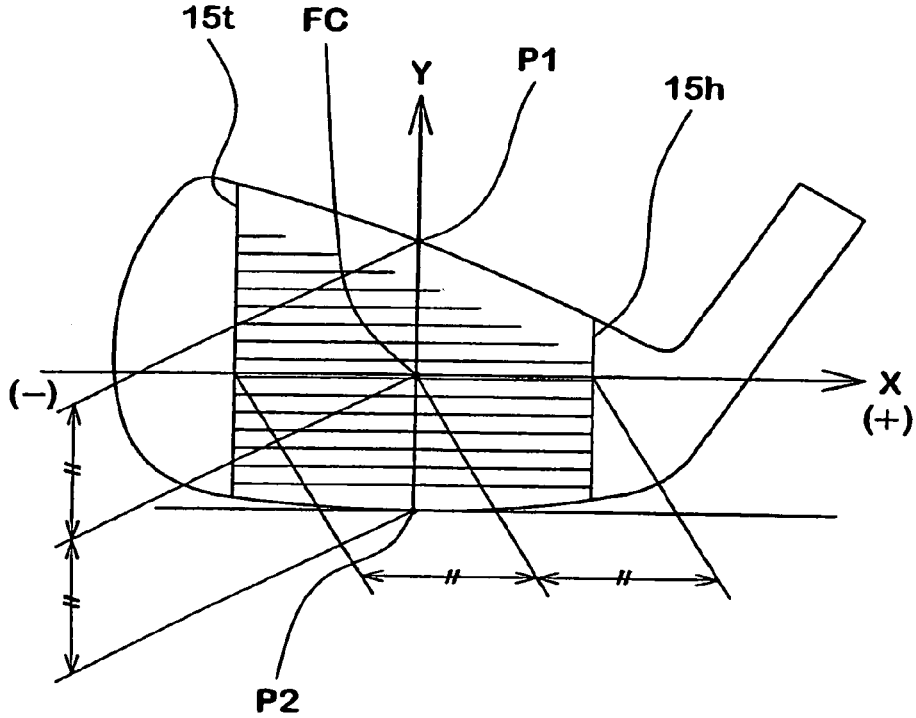
FIG. 6 is a diagram of a head for describing a face center.

Further, the face plate 2A preferably employs a metal material, for example, having a smaller specific gravity than that of the head main body 2B, for example, titanium alloy. The weight: of the head can be distributed more in the peripheral portion of the hitting face F by forming the face plate 2A with the metal material having the smaller specific gravity than that of the head main body 2B. This serves for increasing the sweet area. For example, as shown in FIG. 6, a plurality of face lines 15 constituted by narrow grooves extending in the toe and heel direction are provided on the hitting face F.

The head main body 2B includes: a top portion 10 forming a head upper portion; a sole portion 11 forming a head bottom portion; a toe portion 12 connecting between the top portion 10 and the sole portion 11 on a side of a leading end of the head; a neck portion 13 connecting between the top portion 10 and the heel portion 11 on a side of the heel of the head; and a tubular hosel 14 extending to an upper side from the neck portion 13 and into which the shaft S is inserted.

Further, the head main body 2B is provided with the opening portion O which is surrounded by the top portion 10, the toe portion 12, the sole portion 11 and the neck portion 13 and penetrates backward and forward. The face receiving portion 9 is provided in the periphery of the opening portion O. The face receiving portion 9 is illustrated as a stepped structure including an inner peripheral surface portion 9*a* facing to the outer peripheral surface 7 of the face plate 2A, and a support surface portion 9*b* folded at a rear end of the inner peripheral surface portion 9*a* and facing to the back surface edge portion 8 of the face plate 2A. The face receiving portion 9 is continuously formed in a ring shape around the opening portion O.

The peripheral edge portion E of the face plate 2A and the face receiving portion 9 of the head main body 2B are firmly fixed to each other by fixing means such as adhesion, caulking, press fitting or screwing. Accordingly, the face plate 2A is structured such that the peripheral edge portion E can be supported by the head main body 2B so as to be restrained, and the portion in which the back surface faces to the opening portion O can be secured as a free deflection area 6 which can be deflected without being restrained by the head main body 2A at a time of hitting the ball.

The free deflection area 6 is constituted to include one thin portion 4 having the smallest thickness t1, and at least one thick portion 5 having a larger thickness than the thin portion 4. The thin portion 4 tends to be comparatively deflected at a time of hitting the ball, and serves for improving a repulsion performance of the head by extension. On the other hand, the thick portion 5 inhibits the deflecting generated at a time of hitting the ball, and prevents the durability from being deteriorated. In other words, it is possible to prevent the durability from being deteriorated while improving the repulsion performance by providing the thin portion 4 and the thick portion 5 on the free deflection area 6 of the face plate 2A.

The thickness t1 of the thin portion 4 is not particularly limited, however, is preferably set between 1.0 and 3.0 mm, and more preferably between 1.2 and 2.0 mm. The thin portion 4 improves the repulsion property of the head; however, when the thickness t1 is smaller than 1.0 mm, the strength is short and there is a tendency of deteriorating the durability of the face plate 2A. On the contrary, when the thickness t1 exceeds 3.0 mm, there is a tendency that an effect of improving the repulsion performance is reduced. In the present embodiment, the thin portion 4 has an approximately uniform thickness of 2.0 mm.

The thickness t2 of the thick portion 5 is not particularly limited, however, is preferably set between 2.0 and 4.0 mm, and more preferably between 2.0 and 3.0 mm. When the thickness t2 is smaller than 2.0 mm, it is hard to increase the strength of the face plate 2B which is lowered by the thin portion 4. On the contrary, when the thickness t2 exceeds 4.0 mm, the rigidity of the face plate 2B is excessively increased, and the thickness is not preferable in view of the repulsion performance.

The difference (t2−t1) between the thickness t2 of the thick portion 5 and the thickness t1 of the thin portion 4 is preferably set between 0.2 and 1.5 mm, and more preferably between 0.5 and 1.0 mm. Accordingly, the repulsion property and the durability of the free deflection area 6 can be improved with good balance. In the present embodiment, the thickness t2 of the thick portion 5 is approximately uniform thickness of 3.0 mm. Further, the thick portion 5 is connected to the peripheral edge portion E of the face plate 2A, and has the same thickness as that of the peripheral edge portion E.

Further, it is desirable that the thin portion 4 occupies 15 to 70% of the free deflection area 6, and more preferably 30 to 60% thereof. When the thin portion 4 is less than 15% of the free deflection area 6, the improvement of the repulsion performance is low. On the contrary, when the thin portion 4 exceeds 70% thereof, the durability of the face plate 2A tends to be lowered. In this case, this rate is determined on the basis of the area projected on the hitting face F.

The ball tends to be hit on the toe side of the hitting face F in accordance with the smaller number club 3*a* in which the loft angle is smaller, and the ball tends to be hit on the heel side of the hitting face F in accordance with the larger number club 3*c* in which the loft angle is larger, as described above. In order to obtain the longest carry in each of the clubs 3*a*, 3*b* . . . , it is preferable to set the center Z of figure of the thin portion 4 in correspondence to the change in the ball hitting position. Accordingly, the ball hitting position of the golfer is close to the center of figure of the thin portion 4 having good repulsion, and it is possible to effectively deflect the thin portion 4 of the face plate 2A at a time of hitting the ball. This serves for obtaining the long carry.

In particular, in the standard state where the head 2 is mounted on the horizontal plane at the specified lie angle and loft angle, a horizontal distance Xi along the hitting face F between a face center FC and the center Z of figure of the thin portion 4 satisfies the following conditions (1) and (2):

$$X1 \leqq X2 \leqq \ldots \leqq Xn; \text{ and} \quad (1)$$

$$X1 < Xn. \quad (2)$$

In this case, the horizontal distance Xi is expressed as a negative value in the case where the center Z of figure exists on the toe side rather than the face center FC, and is expressed as a positive value in the case where the center Z of figure exists on the heel side rather than the face center FC. Further, reference symbol i denotes a natural number of 1 to n which is given from the club having the smallest loft angle in the set in a sequential order.

The center Z of figure of the thin portion 4 can be geometrically determined from the profile shape of the thin portion 4 which is projected on the hitting face F. Further, the face center FC passes through a middle of an end 15*t* on a side of the toe of the face line 15 and an end 15*h* on a side of the heel, as shown in FIG. 6, and is set as a middle point between nodal points P1 and P2 which a center line Y in a vertical direction along the hitting face F respectively cross to an upper edge and a lower edge of the hitting face F. In this case, FIG. 6 shows a state where the loft angle is set to 0° and the face line 15 is set horizontal.

In general, the iron type golf club set can be virtually sectioned into three groups in correspondence to the loft angle. Calling the club from the group having the small number, these clubs are called as a long iron, a middle iron and a short iron. Further, the change in the ball hitting position is significantly different between the groups. In the set 1 in accordance with the present invention, in accordance with a preferable aspect, the horizontal distance Xi is substantially the same in each of the groups of the long irons, middle irons and short irons. On the other hand, comparing the respective groups with one another, the horizontal distance Xi is set to be different. In other words, three or more kinds of horizontal distances Xi are included in the set 1 (two or more inequality signs "<" are included in the condition (1)).

Further, giving a concrete example, the horizontal distances X1 to X3 of the third to fifth irons (i=1 to 3), the horizontal distances X4 to X7 of the sixth to ninth irons (i=4 to 7), and the horizontal distances X8 to X10 of the PW, AW and SW (i=8 to 10) are changed in stages as follows:

$$X1(=X2=X3)<X4(=X5=X6=X7)<X8(=X9=X10).$$

Figure 7:
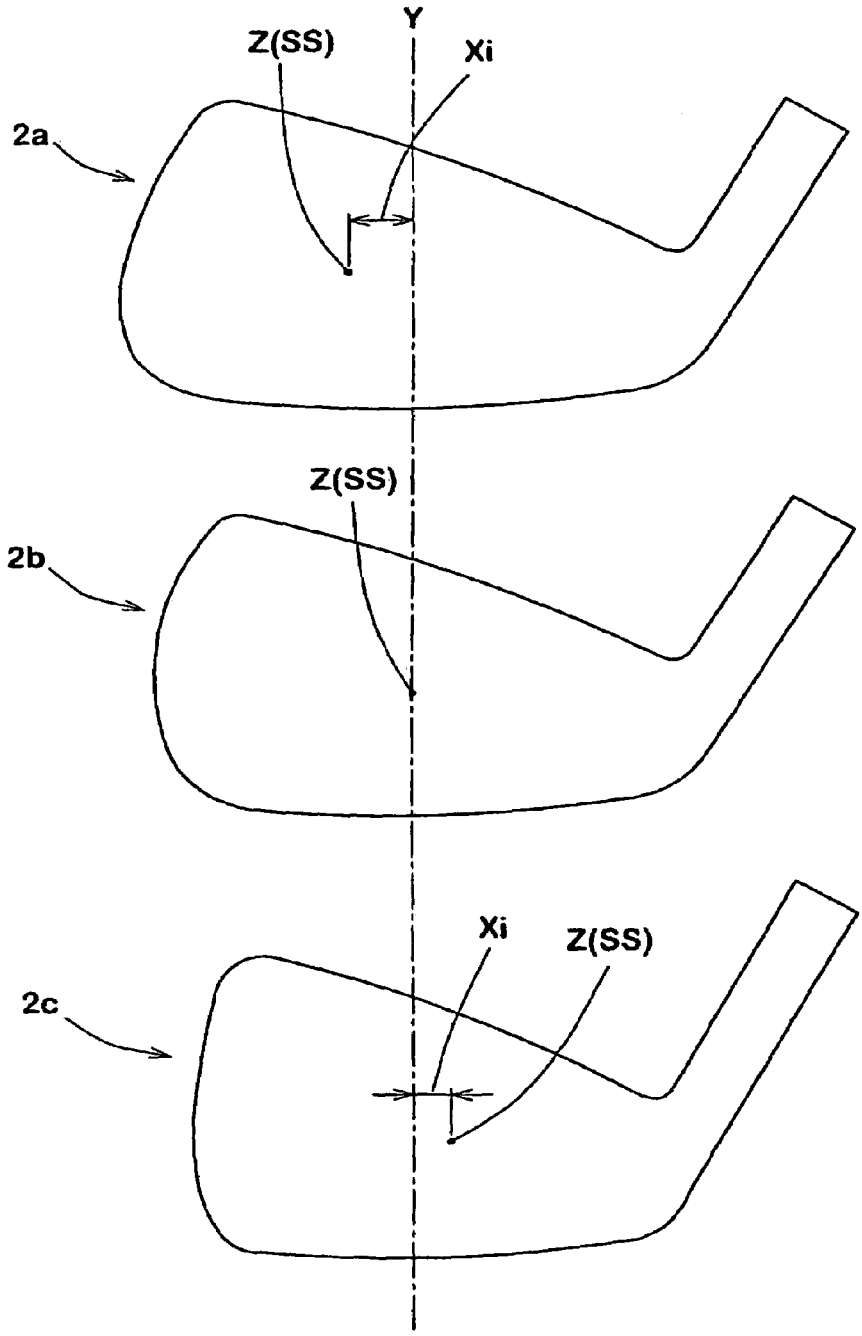
FIG. 7 is a front view showing each of long, middle and short iron heads in which a center line of a face width is aligned.

In this case, in FIG. 7, the respective heads 2*a* to 2*c* are shown in line with aligning the center line Y.

For example, in the long iron having the head in which the loft angle is equal to or less than 28°, such as the third to fifth irons, the thin portion 4 is formed on the side of the toe of the free deflection area 6, and the thick portion 5 is formed on the side of the heel, respectively, as shown in FIGS. 1A and 1B. Accordingly, in the long iron, the center Z of figure of the thin portion 4 can be moved close to the toe side. A boundary portion K between the thin portion 4 and the thick portion 5 is an inclined line, for example, which is inclined to the heel side from the side of the top portion toward the side of the sole portion. Accordingly, there is sectioned the approximately trapezoidal thin portion 4 in which a length Wb on the side of the sole portion is larger than a length Wa on the side of the top portion. The thin portion 4 can secure the area which is larger on the side of the sole portion.

In the long iron, the horizontal distance Xi is preferably set between −5 and 0 mm, and more preferably between −3 and 0 mm. When the horizontal distance Xi is smaller than −5 mm, the center Z of figure tends to be close to the toe side rather than an actual ball hitting position. On the contrary, when the horizontal distance Xi is larger than 0 mm, the center Z of figure tends to be close to the heel side rather than the actual ball hitting position. Accordingly, a general distance between the ball hitting position and the center Z of figure is increased.

In the middle iron having the head in which the loft angle is larger than 28° and equal to or less than 41°, such as the sixth to ninth irons, the thin portion 4 is formed approximately in the center of the free deflection area 6, as shown in FIGS. 2A and 2B. Further, the thick portion 5*t* on the toe side and the thick portion 5*h* on the heel side are formed, for example, on both sides of the thin portion 4. As described above, the thick portion 5 may be provided in two positions. The head 2 can set the center Z of figure of the thin portion 4 closer to the heel side in comparison with the long iron.

In the middle iron, the horizontal distance Xi is preferably set between −3 and +3 mm, and more preferably between −1 and +1 mm. When the horizontal distance Xi is smaller than −3 mm, the center Z of figure tends to be close to the toe side rather than the actual ball hitting position. On the contrary, when the horizontal distance Xi is larger than +3 mm, the center Z of figure tends to be close to the heel side rather than the actual ball hitting position.

Further, in the short iron having the head in which the loft angle is larger than 410, for example, the pitching wedge to the sand wedge, the thin portion 4 is formed on the heel side from the center of the free deflection area 6, as shown in FIGS. 3A and 3B, and the thick portion 5 is formed on the toe side of the thin portion 4. Accordingly, it is possible to easily set the center Z of figure of the thin portion 4 further closer to the heel side in comparison with the middle iron.

In the short iron, the horizontal distance Xi is preferably set between 0 and +5 mm, and more preferably between 0 and +3 mm. When the horizontal distance Xi is smaller than 0 mm, the center Z of figure tends to be close to the toe side rather than the actual ball hitting position. On the contrary, when the horizontal distance Xi is larger than +5 mm, the center Z of figure tends to be close to the heel side rather than the actual ball hitting position.

In this case, in each of the heads 2, the center Z of figure of the thin portion 4 can be easily arranged at a desired position by changing the profile shape. Further, the number of the iron included in each of the long, middle and short iron groups is not limited to the above aspect, and can be variously determined.

The iron type golf club 3 is used in most cases for hitting a ball directly placed on the grass. Accordingly, the hitting position of the ball is set close to the sole of the hitting face F, that is, at a comparatively low position. In the head 2 in accordance with the present embodiment, the wide thin portion 4 is formed in the vicinity of the actual ball hitting position by making the length Wb on the side of the sole portion of the thin portion 4 larger than the length Wa on the side of the top portion. Accordingly, it is possible to more effectively deflect the thin portion 4. This serves for obtaining the further long carry. In view of this, a ratio (Wb/Wa) of the thin portion 4 is preferably set between 1.0 and 4.5, and more preferably between 1.5 and 3.0.

Further, in the standard state, it is desirable that a horizontal distance Si along the hitting face F between the face center FC and the sweet spot SS satisfies the following conditions (3) and (4):

$$S1 \leqq S2 \leqq \ldots \leqq Sn; \text{ and} \quad (3)$$

$$S1 < Sn. \quad (4)$$

Figure 5A:
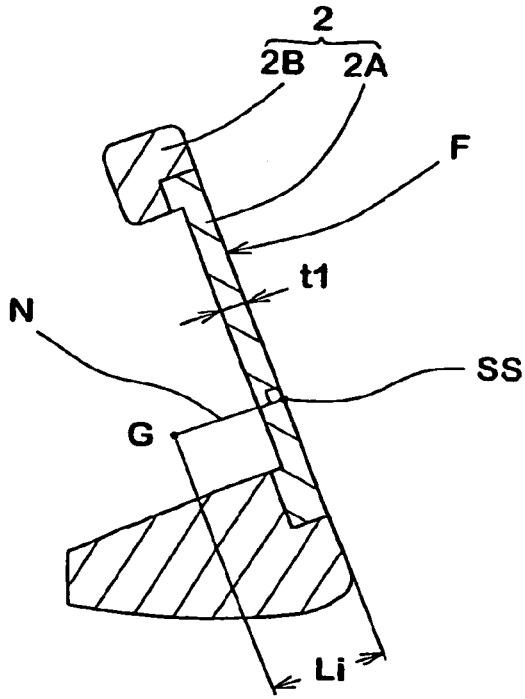
FIG. 5A is an end view taken along line A—A in FIG. 2A.
Figure 5B:
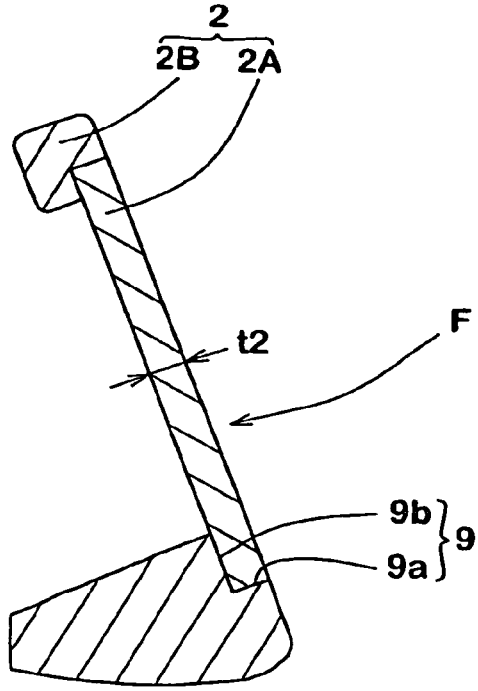
FIG. 5B is an end view taken along line B—B in FIG. 2A.

The sweet spot SS is a foot of a normal line N drawn from the center of gravity G of the head to the hitting face F, as shown in FIG. 5A. Further, the horizontal distance Si is set negative in the case where the sweet spot SS exists on the side close to the toe rather than the face center FC, and is set positive in the case where the sweet spot SS exists on the side close to the heel rather than the face center FC. Further, reference symbol i is 1 to n, which is given in a sequential order from the club having the smallest loft angle in the set.

It is possible to set the ball hitting position of the average golfer close to not only the center Z of figure of the thin portion 4 having the good repulsion property but also the sweet spot SS being deemed to have the good ball hitting directionality, by satisfying the conditions (3) and (4).

Accordingly, it is possible to obtain the long carry while increasing the directionality of the hit ball. Further, it is preferable to change the horizontal distance Si at least between the respective groups comprising the long, middle and the short iron groups, in the same manner as that of the horizontal distance Xi.

In the present embodiment, the sweet spot SS is provided so as to be substantially coincided with the center Z of figure of the thin portion 4. In this case, the structure is not limited to the above aspect. For example, it is preferable that a horizontal distance J between the center Z of figure of the thin portion 4 and the sweet spot SS is set, for example, within 2 mm, more preferably within 1 mm. The sweet spot SS can be set to a desired position by suitably adjusting the position of the center of gravity G of the head, and the center of gravity G of the head can be suitably set in accordance with a head weight distribution design.

Further, for example, as shown in FIGS. 1A and 1B, in the long iron, the thin portion 4 is provided on the toe side and the thick portion 5 is provided on the heel side, respectively. In this case, the center of gravity of the head tends to be close to the heel side, and the distance between the center of figure of the thin portion 4 and the sweet spot SS tends to be large by extension. The head 2 in accordance with the present embodiment is structured, for example, such that a weight member 16 having a greater specific gravity than that of the head main body 2B is attached to the toe side in the long iron, and is attached to the heel side in the short iron. Accordingly, it is possible to make the distance between the center Z of figure and the sweet spot SS small. Further, in addition to the way of attaching the weight member 16, the structure may be made, for example, such that the sole width and the sole thickness are made different between the toe side and the heel side.

Further, in each of the heads 2, as shown in FIG. 5A, it is desirable that a depth Li of center of gravity corresponding to the distance between the center of gravity G of the head and the sweet spot SS satisfies the following conditions (5) and (6):

$$L1 \geqq \ldots \geqq Li \geqq \ldots \geqq Ln; \text{ and} \quad (5)$$

$$L1 > Ln. \quad (6)$$

In this case, i 1 to n, and is attached in a sequential order from the club having the smallest loft angle in the set.

In general, the head having the large depth Li of center of gravity tends to hit the ball higher. In the present embodiment, the ball is easily hit high by setting the depth of center of gravity of the head in the low number to be large, and an improvement of the long carry can be intended. Further, it is possible to prevent the ball from being hit significantly high by setting the depth of center of gravity of the head having the small loft angle to be relatively small, whereby it is possible to increase a controllability.

In the long iron, the depth Li of center of gravity is desirably between 3.5 and 8.0 mm, and more preferably between 4.0 and 6.0 mm. Further, in the middle iron, the depth Li of center of gravity is desirably between 2.0 and 6.0 mm, and more preferably between 3.0 and 4.5 mm. Further, in the short iron, the depth Li of center of gravity is desirably between 1.0 and 3.0 mm, and more preferably between 0 and 1.5 mm.

Figure 8A:
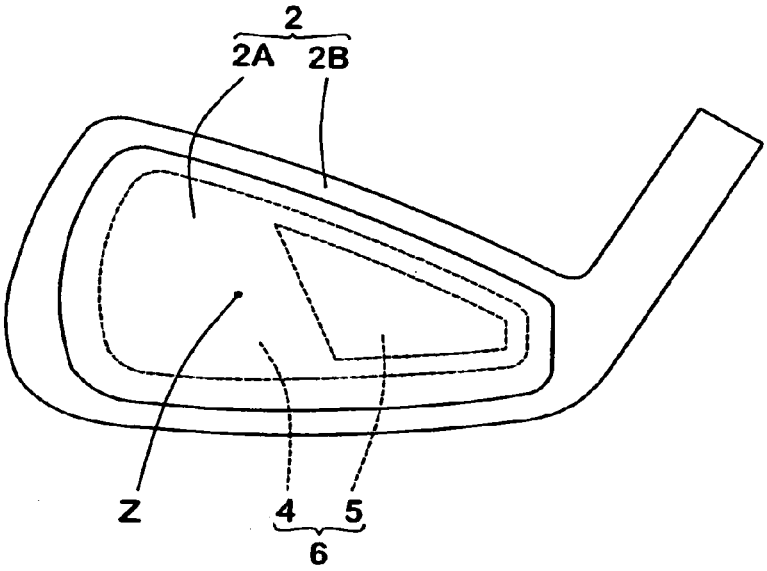
FIG. 8A is a front view showing another embodiment of an iron type golf club.
Figure 8B:
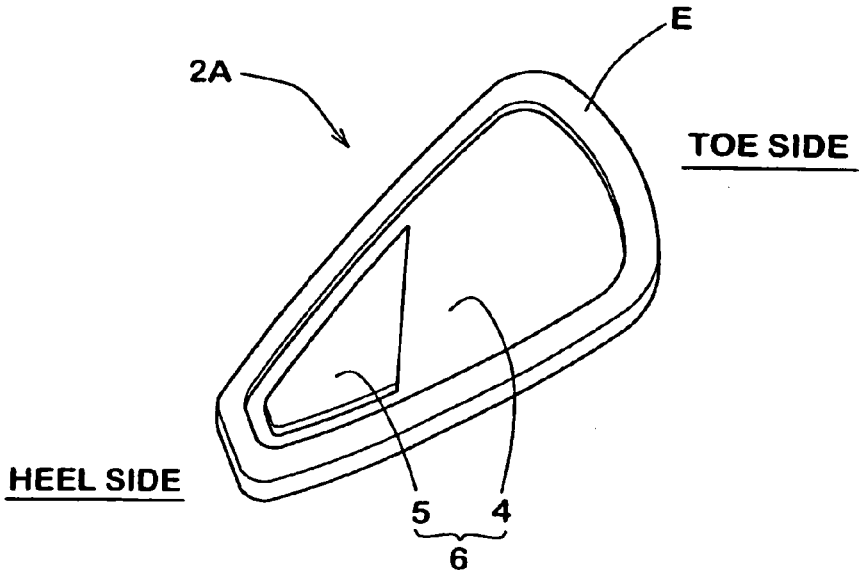
FIG. 8B is a perspective view of the iron type golf club as seen from its back surface from which a face plate is detached.
Figure 9A:
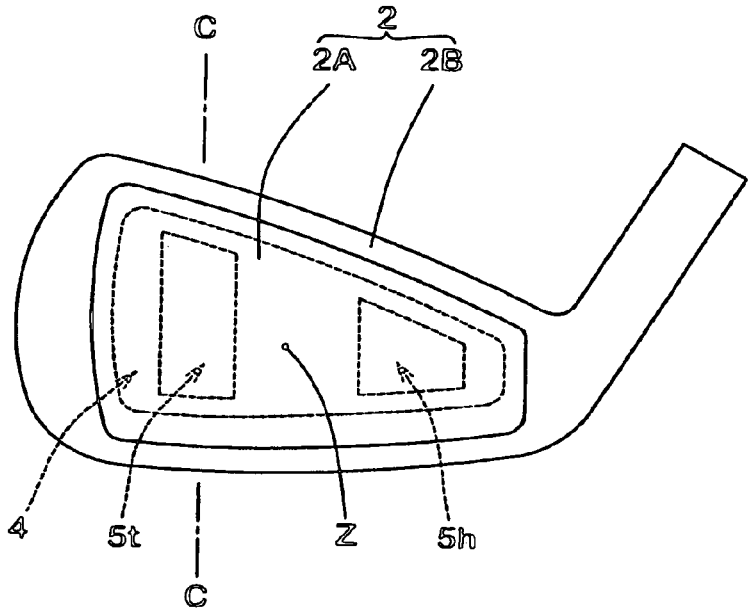
FIG. 9A is a front view showing another embodiment of an iron type golf club.
Figure 9B:
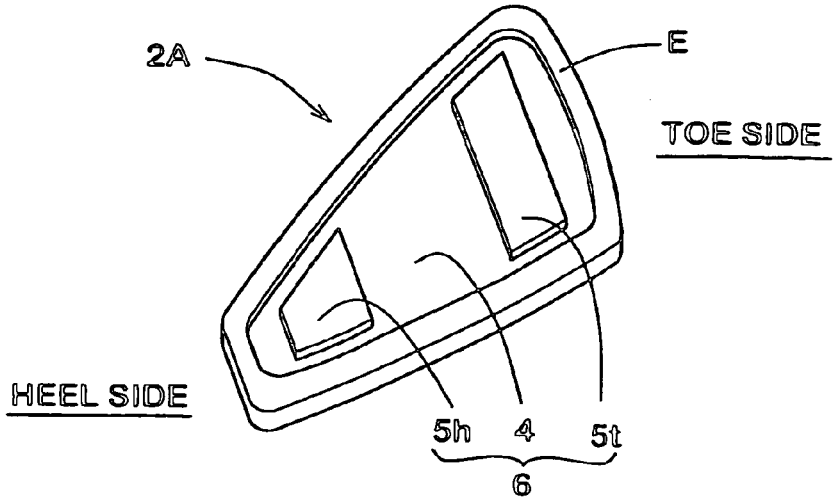
FIG. 9B is a perspective view of the iron type golf club as seen from its back surface from which a face plate is detached.
Figure 10A:
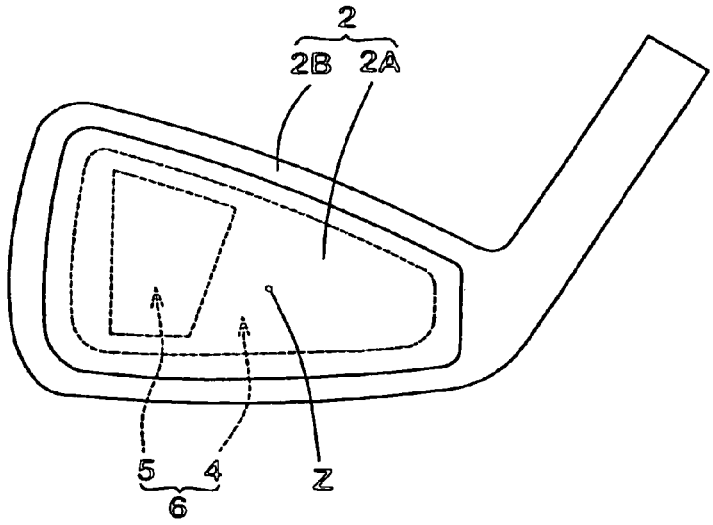
FIG. 10A is a front view showing another embodiment of an iron type golf club.
Figure 10B:
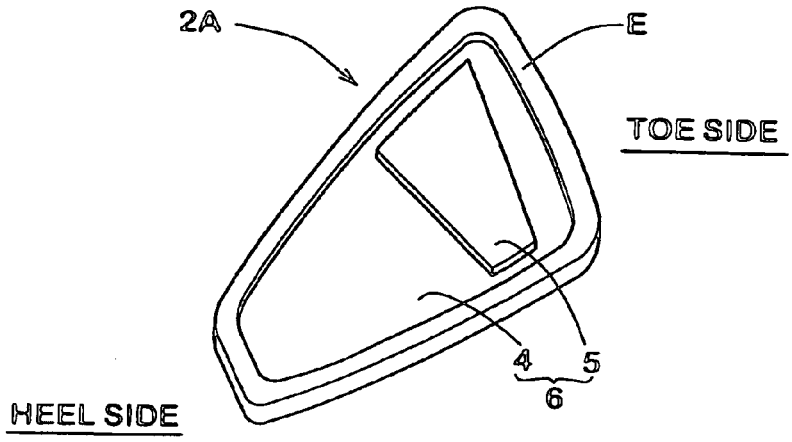
FIG. 10B is a perspective view of the iron type golf club as seen from its back surface from which a face plate is detached.
Figure 11:
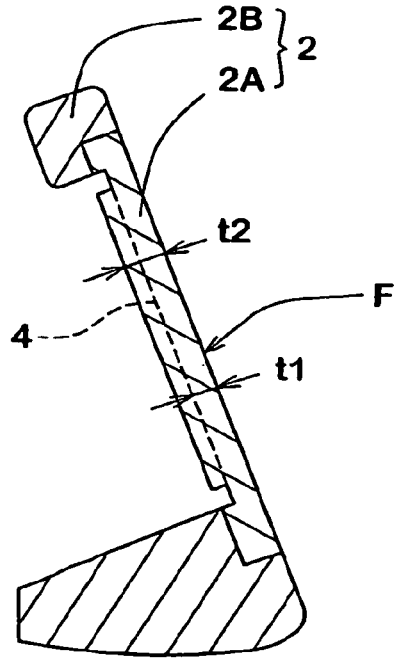
FIG. 11 is an end view taken along line C—C in FIG. 9A.
Figure 12:
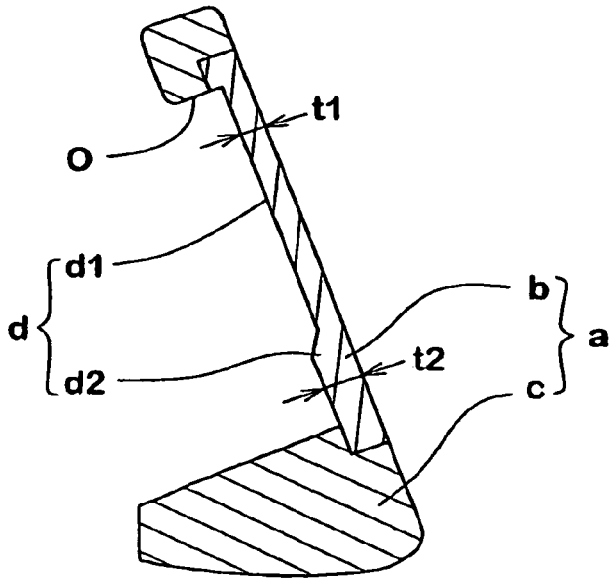
FIG. 12 is a cross sectional view of a conventional head.

In FIGS. 8A and 8B to 10A to 10B, there is shown another embodiment in accordance with the present invention. FIGS. 8A and 8B show a long iron, FIGS. 9A and 9B show a middle iron and FIGS. 10A and 10B show a short iron, respectively. In the drawings, FIGS. 8A, 9A and 10A are front views of a head in a standard state, and FIGS. 8B, 9B and 10B are perspective views of the head as seen from its back surface from which the face plate is detached. This embodiment is different from the above embodiment in a point that the thick portion 5 of the face plate 2A is not connected to the peripheral edge portion E but is separated from the peripheral edge portion E. In accordance with the above aspect, the thin portion 4 annularly surrounds the free deflection area 6. Accordingly, the free deflection area 6 can be more effectively deflected at a time of hitting the ball, and serves for obtaining the further longer carry.

EXAMPLES

A comparative test was applied to an iron type golf club set having the specification shown in Table 1. A common specification of each of the clubs is as follows:

Face plate: Ti-6Al-4V
Head main body: stainless steel (SUS630)
Entire length of club (unit: inch)
Third iron: 39.0
Fourth iron: 38.5
Fifth iron: 38.0
Sixth iron: 37.5
Seventh iron: 37.0
Eighth iron: 36.5
Ninth iron: 36.0
PW: 35.5
AW: 35.5
SW: 35.5

Contents of test are as follows.

(Ball Hitting Test)

The carry in all the clubs was measured. Testers are constituted by ten right-handed golfers (having handicaps between 10 and 15). A result is obtained by an average of fifty samples.

(Strength Test)

The 1000 times ball hitting tests were performed in all the clubs by using a swing robot, and an amount of depression on the hitting face was measured. The hitting conditions and the like are as follows.

Head speed: 40 m/s

Golf ball: "MXFRI HI-BRID" manufactured by Sumitomo Rubber Industries, Ltd.

Evaluation:

Amount of depression less than 0.1 mm: OK

Amount of depression equal to or more than 0.1 mm: NG

Further, in this example, the clubs are divided into the long iron having the loft angle between 20° and 26°, the middle iron having the loft angle between 29° and 40°, and the short iron having the loft angle between 45° and 56°. In each the groups, the horizontal distances. Xi are uniform, however the horizontal distances Xi in each of the groups are different. Results of test are shown in Table 1.

TABLE 1

| | | Group | | | | | | | | | |
|---|---|---|---|---|---|---|---|---|---|---|---|
| | | Long iron | | | Middle iron Loft angle (deg) | | | | Short iron | | |
| | | 20 | 23 | 26 | 29 | 32 | 36 | 40 | 45 | 51 | 56 |
| | | Number of iron (engraved mark No. of head) | | | | | | | | | |
| | | #3 | #4 | #5 | #6 | #7 | #8 | #9 | PW | AW | SW |
| Example 1 | Depth of center of gravity Li (mm) | 5 | 5 | 5 | 4.5 | 4.5 | 4.5 | 4.5 | 4 | 4 | 4 |
| | Horizontal distance Si (mm) | −2 | −2 | −2 | 0 | 0 | 0 | 0 | 2 | 2 | 2 |
| | Horizontal distance Xi (mm) | −2 | −2 | −2 | 0 | 0 | 0 | 0 | 2 | 2 | 2 |
| | Thickness t2 of thick portion (mm) | 3 | 3 | 3 | 3 | 3 | 3 | 3 | 3 | 3 | 3 |
| | Thickness t1 of thin portion (mm) | 2 | 2 | 2 | 2 | 2 | 2 | 2 | 2 | 2 | 2 |
| | Average carry (m) | 182 | 174 | 164 | 156 | 145 | 132 | 117 | 102 | 95 | 86 |
| | Strength evaluation | OK | OK | OK | OK | OK | OK | OK | OK | OK | OK |
| Example 2 | Depth of gravity Li (mm) | 4 | 4 | 4 | 4 | 4 | 4 | 4 | 4 | 4 | 4 |
| | Horizontal distance Si (mm) | −2 | −2 | −2 | 0 | 0 | 0 | 0 | 2 | 2 | 2 |
| | Horizontal distance Xi (mm) | −2 | −2 | −2 | 0 | 0 | 0 | 0 | 2 | 2 | 2 |
| | Thickness t2 of thick portion (mm) | 3 | 3 | 3 | 3 | 3 | 3 | 3 | 3 | 3 | 3 |
| | Thickness t1 of thin portion (mm) | 2 | 2 | 2 | 2 | 2 | 2 | 2 | 2 | 2 | 2 |
| | Average carry (m) | 180 | 172 | 162 | 154 | 143 | 130 | 115 | 100 | 93 | 84 |
| | Strength evaluation | OK | OK | OK | OK | OK | OK | OK | OK | OK | OK |
| Comparative Example 1 | Depth of center of gravity Li (mm) | 4 | 4 | 4 | 4 | 4 | 4 | 4 | 4 | 4 | 4 |
| | Horizontal distance Si (mm) | 0 | 0 | 0 | 0 | 0 | 0 | 0 | 0 | 0 | 0 |
| | Horizontal distance Xi (mm) | 0 | 0 | 0 | 0 | 0 | 0 | 0 | 0 | 0 | 0 |
| | Thickness of face plate (mm) | 3 | 3 | 3 | 3 | 3 | 3 | 3 | 3 | 3 | 3 |
| | Average carry (m) | 177 | 169 | 159 | 151 | 140 | 128 | 113 | 98 | 91 | 81 |
| | Strength evaluation | OK | OK | OK | OK | OK | OK | OK | OK | OK | OK |
| Comparative Example 2 | Depth of center of gravity Li (mm) | 5 | 5 | 5 | 4.5 | 4.5 | 4.5 | 4.5 | 4 | 4 | 4 |
| | Horizontal distance Si (mm) | −2 | −2 | −2 | 0 | 0 | 0 | 0 | 2 | 2 | 2 |
| | Horizontal distance Xi (mm) | −2 | −2 | −2 | 0 | 0 | 0 | 0 | 2 | 2 | 2 |
| | Thickness of face plate (mm) | 2 | 2 | 2 | 2 | 2 | 2 | 2 | 2 | 2 | 2 |
| | Average carry (m) | 183 | 175 | 165 | 156 | 145 | 132 | 117 | 102 | 94 | 85 |
| | Strength evaluation | NG | NG | NG | NG | NG | NG | OK | OK | OK | OK |
| Comparative Example 3 | Depth of gravity Li (mm) | 5 | 5 | 5 | 4.5 | 4.5 | 4.5 | 4.5 | 4 | 4 | 4 |
| | Horizontal distance Si (mm) | −2 | −2 | −2 | 0 | 0 | 0 | 0 | 2 | 2 | 2 |
| | Horizontal distance Xi (mm) | −2 | −2 | −2 | 0 | 0 | 0 | 0 | 2 | 2 | 2 |

TABLE 1-continued

| | | Group | | | | | | | | | |
|---|---|---|---|---|---|---|---|---|---|---|---|
| | | Long iron | | | Middle iron | | | | Short iron | | |
| | | Loft angle (deg) | | | | | | | | | |
| | | 20 | 23 | 26 | 29 | 32 | 36 | 40 | 45 | 51 | 56 |
| | | Number of iron (engraved mark No. of head) | | | | | | | | | |
| | | #3 | #4 | #5 | #6 | #7 | #8 | #9 | PW | AW | SW |
| | Thickness of face plate (mm) | 2.5 | 2.5 | 2.5 | 2.5 | 2.5 | 2.5 | 2.5 | 2.5 | 2.5 | 2.5 |
| | Average carry (m) | 181 | 173 | 163 | 152 | 142 | 130 | 116 | 101 | 92 | 82 |
| | Strength evaluation | NG | NG | OK | OK | OK | OK | OK | OK | OK | OK |
| Comparative Example 4 | Depth of center of gravity Li (mm) | 5 | 5 | 5 | 4.5 | 4.5 | 4.5 | 4.5 | 4 | 4 | 4 |
| | Horizontal distance Si (mm) | −2 | −2 | −2 | 0 | 0 | 0 | 0 | 2 | 2 | 2 |
| | Horizontal distance Xi (mm) | 0 | 0 | 0 | 0 | 0 | 0 | 0 | 0 | 0 | 0 |
| | Thickness t2 of thick portion (mm) | 3 | 3 | 3 | 3 | 3 | 3 | 3 | 3 | 3 | 3 |
| | Thickness t1 of thin portion (mm) | 2 | 2 | 2 | 2 | 2 | 2 | 2 | 2 | 2 | 2 |
| | Average carry (m) | 178 | 170 | 160 | 154 | 143 | 131 | 116 | 99 | 90 | 81 |
| | Strength evaluation | OK | OK | OK | OK | OK | OK | OK | OK | OK | OK |

In Comparative Example 1, the thickness of the free deflection area of the face plate is all large 3.0 mm. Accordingly, Comparative Example 1 has an excellent strength, however, has a deteriorated repulsion property and a short carry. On the contrary, in Comparative Example 2, since the thickness of the free deflection area is all small 2.0 mm, Comparative Example 2 has an improved repulsion property and a long carry, however, has a deteriorated durability.

Comparative Example 3 in which the thickness of the free deflection area is set to 2.5 mm in all the area exhibits an intermediate performance between Comparative Example 1 and Comparative Example 2 in view of the carry. However, the strength is short in the long iron by which a high head speed can be obtained. Further, in Comparative Example 4, a sufficient distance can be obtained in the middle iron, however, an improvement of carry is hardly seen in the long and middle irons.

In comparison with these comparative examples, in accordance with the sets of Example 1 and Example 2, the long carry can be obtained in all the number of the irons while keeping the strength. In other words, it is possible to confirm an advantage of the present invention.

As described above, in accordance with the present invention, it is possible to provide the iron type golf club set which can obtain the longest carry in each of the irons while keeping the durability, by optimally changing the position of the center of figure of the thin portion provided in the free deflection area of the face plate in accordance with the number of the irons. Further, in the case of optimally changing the sweet spot and the depth of center of gravity in accordance with the number of the iron, it is possible to further increase the carry.

What is claimed is:

1. An iron type golf club set of n (n: an integer equal to or more than three) numbers of iron type golf clubs having different head loft angles, wherein the set comprises at least one long iron having the head with the loft angle of not more than 28 degrees, at least one middle iron having the head with the loft angle being larger than 28 degrees and equal to or less than 41 degrees and at least one short iron having the head with the loft angle of not less than 41 degrees, each head comprises a face plate having a hitting face on its front, and a head main body provided with a face receiving portion supporting a peripheral edge portion of the face plate around an opening portion, each face plate has one thin portion having the smallest thickness and at least one thick portion having a larger thickness than the thin portion, in a free deflection area in which a back surface of the face plate faces to the opening portion, each head of the long iron and short iron comprises a weight member having a specific gravity greater than that of each head main body, the weight member of the long iron is attached to a toe side of the head main body, the weight member of the short iron is attached to a heel side of the head main body, and in a standard state where the head is mounted on a horizontal plane by a specified lie angle and loft angle, a horizontal distance Xi along the hitting face between a face center and a center of figure of the thin portion satisfies the following conditions (1) to (2):

$$X1 \leqq X2 \leqq \ldots \leqq Xn; \text{ and} \quad (1)$$

$$X1 < Xn; \quad (2)$$

wherein the horizontal distance Xi is negative in the case where the center of figure exists on the toe side relative to the face center, and is positive in the case where the center of figure exists on the heel side relative to the face center, and the reference symbol i is a natural number of 1 to n and is given in a sequential order from the club having the smallest loft angle in the set.

2. The iron type golf club set according to claim 1, wherein a depth Li (i is a natural number of 1 to n, and is attached in a sequential order from the club having the smallest loft angle in the set) of center of gravity corresponding to a distance between the center of gravity of the head and a sweet spot, which is a foot of a normal line drawn from the center of gravity of the head to the hitting face, satisfies the following conditions (5) and (6):

$$L1 \geqq \ldots \geqq L2 \geqq \ldots \geqq Ln; \text{ and} \quad (5)$$

$$L1 > Ln. \quad (6)$$

3. The iron type golf club set according to claim 1, wherein the thin portion occupies 15 to 70% of the free deflection area.

4. The iron type golf club set according to claim 1, wherein the thickness of the thin portion is between 1.2 and 2.0 mm, the thickness of the thick portion is between 2.0 and 4.0 mm, and the difference between the thickness of the thick portion and the thickness of the thin portion is between 0.2 and 1.5 mm.

5. The iron type golf club set according to claim 1, wherein the thin portion is formed in an approximately trapezoidal shape in which a horizontal length Wb on a side of a sole portion of the head is longer than a horizontal length Wa on a side of a top portion of the head.

6. The iron type golf club set according to claim 1, wherein the thin portion is formed in an approximately trapezoidal shape in which a horizontal length Wb on a side of a sole portion of the head is longer than a horizontal length Wa on a side of a top portion of the head, and a ratio (Wb/Wa) of the lengths is between 1.0 and 4.5.

7. The iron type golf club set according to claim 1, wherein the set comprises:

at least one long iron having the head with the loft angle of not more than 28 degrees and the horizontal distance Xi of from −5 to 0 mm;

at least one middle iron having the head with the loft angle being larger than 28 degrees and equal to or less than 41 degrees and the horizontal distance Xi of from −3 to 3 mm; and at least one short iron having the head with the loft angle of not less than 41 degrees and the horizontal distance Xi of from 0 to 5 mm.

8. The iron type golf club set according to claim 7, wherein the horizontal distance Xi of the middle iron is larger than that of the long iron, and the horizontal distance Xi of the short iron is larger than that of the middle iron.

9. The iron type golf club set according to claim 1, wherein a sweet spot, which is a foot of a normal line drawn from the center of gravity of the head to the hitting face, is provided so as to be substantially coincided with the center of figure of the thin portion in each head.

10. The iron type golf club set according to claim 1, wherein a sweet spot, which is a foot of a normal line drawn from the center of gravity of the head to the hitting face, is provided in the thin portion in each head.

11. The iron type golf club set according to claim 1, wherein a horizontal distance between the center of figure of the thin portion and a sweet spot, which is a foot of a normal line drawn from the center of gravity of the head to the hitting face, is set within 2 mm.

12. The iron type golf club set according to claim 1, wherein the head of the long iron has one thin portion being formed on the side of the toe of the free deflection area and one thick portion being formed on the side of the heel, the head of the middle iron has one thin portion being formed approximately in the center of the free deflection area and two thick portions being formed on both sides of the thin portion, and the head of the short iron has one thin portion being formed on the heel side from the center of the free deflection area and one thick portion being formed on the toe side of the thin portion.

13. The iron type golf club set according to claim 1, wherein a horizontal distance Si along the hitting face between the face center and a sweet spot which is a foot of a normal line drawn from the center of gravity of the head to the hitting face satisfies the following conditions (3) to (4):

$$S1 \leqq S2 > \ldots \leqq Sn; \text{and} \quad (3)$$

$$S1 < Sn; \quad (4)$$

wherein the horizontal distance Si is negative in the case where the sweet spot exists on a toe side relative to the face center, and is positive in the case where the sweet spot exists on a heel side relative to the face center.

14. An iron type golf club set of n (n: an integer equal to or more than three) numbers of iron type golf clubs having different head loft angles, wherein each head comprises a face plate having a hitting face on its front, and a head main body provided with a face receiving portion supporting a peripheral edge portion of the face plate around an opening portion, the face plate has one thin portion having the smallest thickness and at least one thick portion having a larger thickness than the thin portion, in a free deflection area in which a back surface of the face plate faces to the opening portion, the thin portion is formed in an approximately trapezoidal shape in which a horizontal length Wb on a side of a sole portion of the head is longer than a horizontal length Wa on a side of a top portion of the head, and in a standard state where the head is mounted on a horizontal plane by a specified lie angle and loft angle, a horizontal distance Xi along the hitting face between a face center and a center of figure of the thin portion satisfies the following conditions (1) and (2):

$$X1 \leqq X2 \leqq \ldots \leqq Xn; \text{ and} \quad (1)$$

$$X1 < Xn; \quad (2)$$

wherein the horizontal distance Xi is negative in the case where the center of figure exists on a toe side relative to the face center, and is positive in the case where the center of figure exists on a heel side relative to the face center, and further the reference symbol i is a natural number of 1 to n and is given in a sequential order from the club having the smallest loft angle in the set.

15. An iron type golf club set of n (n: an integer equal to or more than three) numbers of iron type golf clubs having different head loft angles, wherein each head comprises a face plate having a hitting face on its front, and a head main body provided with a face receiving portion supporting a peripheral edge portion of the face plate around an opening portion, the face plate has one thin portion having the smallest thickness and at least one thick portion having a larger thickness than the thin portion, in a free deflection area in which a back surface of the face plate faces to the opening portion, and the thin portion is formed in an approximately trapezoidal shape in which a horizontal length Wb on a side of a sole portion of the head is longer than a horizontal length Wa on a side of a top portion of the head.

* * * * *